US006618997B2

(12) United States Patent
Yokomori

(10) Patent No.: US 6,618,997 B2
(45) **Date of Patent: *Sep. 16, 2003**

(54) CONTROL METHOD OF SLIDING A VEHICLE DOOR BY A POWERED SLIDING DEVICE

(75) Inventor: Kazuhito Yokomori, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/029,001

(22) Filed: Dec. 28, 2001

(65) Prior Publication Data

US 2002/0088180 A1 Jul. 11, 2002

(30) Foreign Application Priority Data

Dec. 28, 2000 (JP) ..... 2000-403278

(51) Int. Cl.[7] ..... E06B 3/00
(52) U.S. Cl. ..... 49/506; 477/27; 477/203

(58) Field of Search ..... 49/360, 506; 192/12 R; 477/203, 27

(56) References Cited

U.S. PATENT DOCUMENTS

| | | | | | |
|---|---|---|---|---|---|
| 6,087,794 | A | * | 7/2000 | Kawanobe | 49/360 |
| 6,120,257 | A | * | 9/2000 | Saiki et al. | 192/12 R |
| 6,198,242 | B1 | | 3/2001 | Yokomori et al. | |
| 6,359,762 | B1 | * | 3/2002 | Yokomori | 361/51 |
| 6,425,206 | B1 | * | 7/2002 | Noda et al. | 49/360 |

* cited by examiner

*Primary Examiner*—Jerry Redman
(74) *Attorney, Agent, or Firm*—Browdy and Neimark, P.L.L.C.

(57) ABSTRACT

A control method of sliding a vehicle door by a powered sliding device with a clutch mechanism comprises the steps of stopping a motor in a state that a rotation of a wire drum is restricted by an auxiliary brake when the slide door reaches at a desired semi-open position; displacing the clutch mechanism into a second coupled state by the motor while the auxiliary brake is actuated; releasing the restriction by the auxiliary brake when a predetermined time has elapsed.

3 Claims, 10 Drawing Sheets

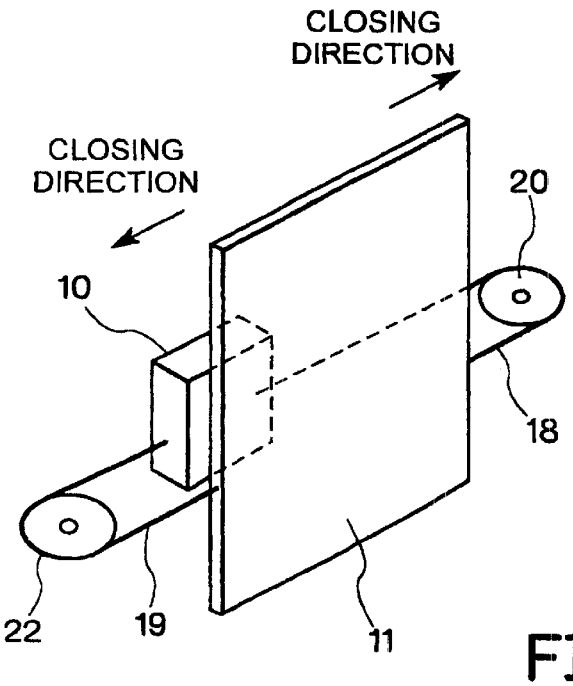
FIG. 1
FIG. 2
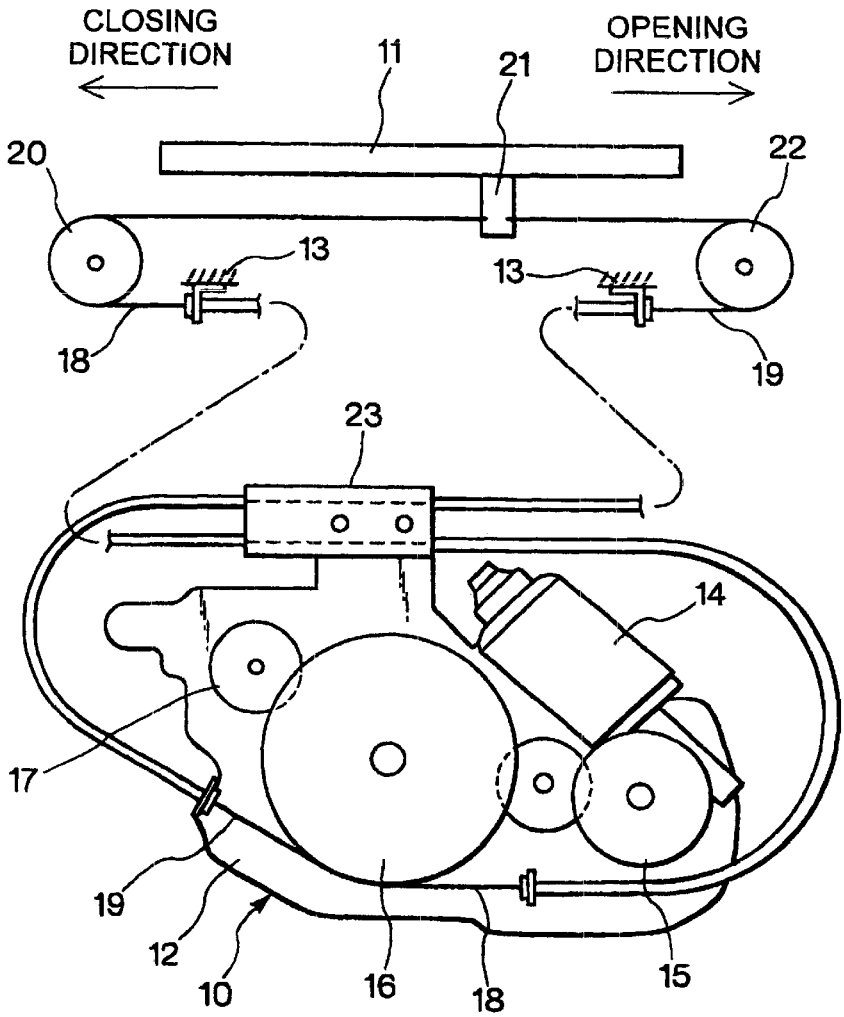

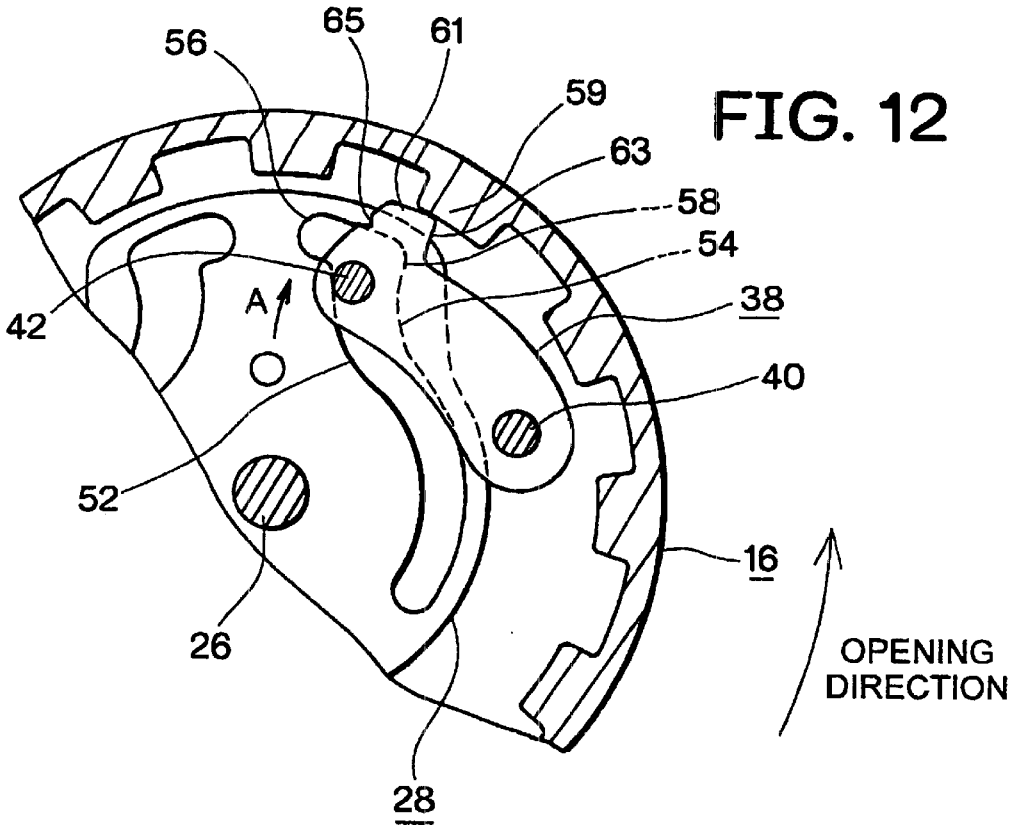
FIG. 12
FIG. 13
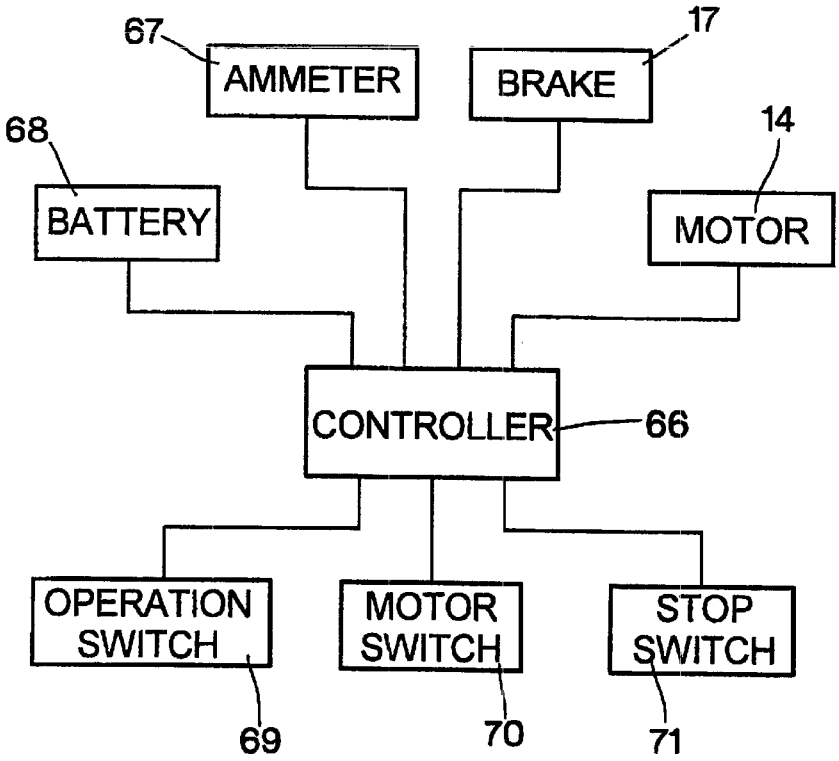

CONTROL METHOD OF SLIDING A VEHICLE DOOR BY A POWERED SLIDING DEVICE

FIELD OF THE INVENTION

The present invention relates to a control method of sliding a vehicle door by a powered sliding device.

DESCRIPTION OF THE PRIOR ART

U.S. Pat. No. 6,198,242B1 discloses a clutch mechanism for a powered sliding device for sliding a vehicle door. This clutch mechanism is switched to a first coupled state for transmitting a door-closing rotation of a motor to a wire drum when the motor is rotated in the closing direction, and is switched to a second coupled state for transmitting a door-opening rotation of the motor to the wire drum when the motor is rotated in the opening direction. Further, the clutch mechanism is switched to a first brake state for transmitting the closing rotation of the wire drum to the motor when the wire drum is relatively rotated in the closing direction with respect to the motor in the first coupled state, and is switched to a second brake state for transmitting the opening rotation of the wire drum to the motor when the wire drum is relatively rotated in the opening direction with respect to the motor in the second coupled state. Furthermore, the clutch mechanism is switched to an uncoupled state when the motor is rotated in the opening direction in the first coupled state or the motor is rotated in the closing direction in the second coupled state. Alternatively, when the wire drum is rotated in the opening direction in the first brake state or the drum is rotated in the closing direction in the second brake state, the clutch mechanism is returned to the uncoupled state.

The prior art sliding device provided with the above clutch mechanism has a function of holding a sliding door in a desired semi-open position between a closed position and an open position. However, this semi-open holding function does not work under a specific condition. The reason why the semi-open holding function does not work will be described later in detail in a column of "Door-Opening Cancellation Operation" according to an embodiment of the present invention. Because the clutch mechanism should be sufficiently appreciated in order to understand this reason.

SUMMARY OF THE INVENTION

An object of the present invention is to overcome the above disadvantage by using a clutch mechanism and an auxiliary brake in combination with them.

Alternatively, an object of the present invention is to provide a control method to decrease a possibility that a holding function of the clutch mechanism is released unintentionally when a vehicle body is in a nose-down inclined state.

BRIEF DESCRIPTION OF THE DRAWINGS

FIG. 1 is a perspective view showing a relation between a sliding door and a powered sliding device according to the present invention;

FIG. 2 is a development view of the sliding door and the sliding device;

FIG. 12 is a partially cutaway sectional view showing a state where the wire drum is further rotated in the opening direction from the state shown in FIG. 11 to make the clutch mechanism into the uncoupled state;

FIG. 13 is a diagram of a block circuit for performing control operations of the present invention;

DESCRIPTION OF THE PREFERRED EMBODIMENTS

Figure 3:
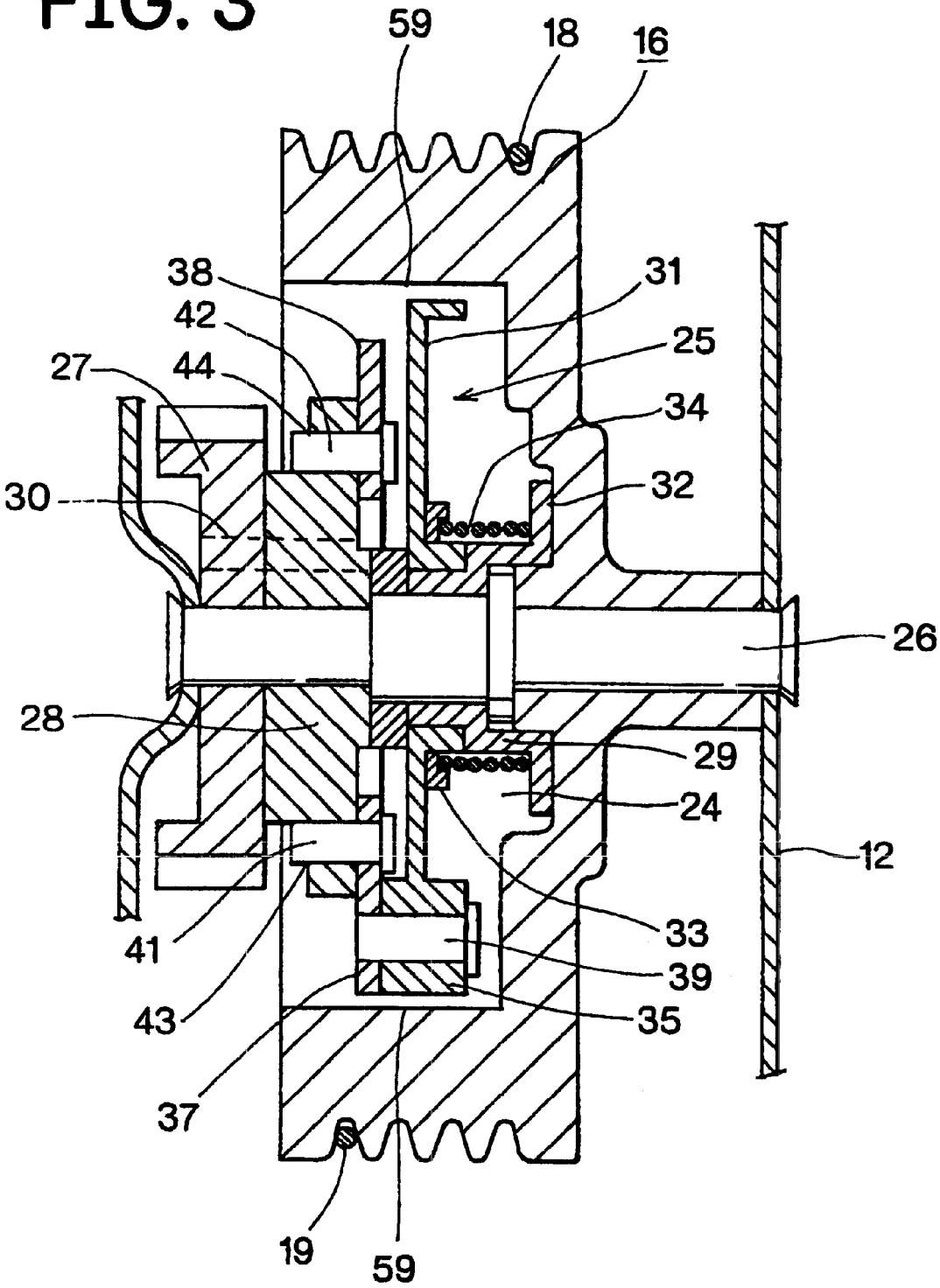
FIG. 3 is a longitudinal sectional side view of the sliding device.

An embodiment of the present invention will be explained with reference to the drawings below. FIG. 1 shows a schematic relation between a powered sliding device 10 according to the present invention and a vehicle sliding door 11 which is slidable in a closing direction and an opening direction by the powered sliding device 10. FIG. 2 shows a relation that the both of them are developed. The powered sliding device 10 has a motor 14, a reduction mechanism 15, a wire drum 16 and an auxiliary brake 17, and they are mounted on a base plate 12 fixed on a vehicle body 13. The auxiliary brake 17 has an electric control part such as a solenoid or the like. The auxiliary brake 17 applies the rotation resistance to the wire drum 16 when actuated.

One end sides of two wire cables 18 and 19 are coupled to the wire drum 16. Other end side of the first cable 18 is coupled to a bracket 21 of the sliding door 11 via a front side pulley 20 which is attached to the vehicle body 13. Similarly, other end side of the second cable 19 is coupled to the bracket 21 via a rear side pulley 22 attached to the vehicle body 13. When the wire drum 16 is rotated clockwise, the first cable is rewound as well as the second wire cable 19 is derived, so that the sliding door 11 is slid in the closing direction. When the wire drum 16 is rotated counterclockwise, the sliding door 11 is slid in the opening direction.

A tension case 23 with tension springs (not shown) is fixed on the base plate 12 by screws, and a predetermined tension is applied to each of the cables 18 and 19.

As shown in FIG. 3, a clutch mechanism 25 is substantially stored in a relatively large inside space 24 of the wire drum 16. The clutch mechanism 25 has a first coupled state for transmitting the closing rotation of the motor 14 to the wire drum 16, a second coupled state for transmitting the opening rotation of the motor 14 to the wire drum 16, a first brake state for transmitting the closing rotation of the wire drum 16 to the motor 14, a second brake state for transmitting the opening rotation of the wire drum 16 to the motor 14 and an uncoupled state for transmitting neither the closing rotation nor the opening rotation of the wire drum 16 to the motor 14.

A drum shaft 26 of the wire drum 16 is rotatably attached with a motor gear 27, a motor plate 28 and a stepped sleeve 29, respectively. The motor gear 27 is coupled to the motor 14 via the reduction mechanism 15. The motor gear 27 and the motor plate 28 are integrally coupled by a coupling pin 30 as one piece. Therefore, the motor gear 27 is omitted in FIG. 4 and the figures similar to FIG. 4 for simplifying the figures. A disk-like clutch plate 31 is rotatably attached to a periphery of the sleeve 29. The clutch plate 31 is partially shown by a phantom line in FIGS. 4, 6 and 7. A friction spring 34 is provided between the clutch plate 31 and a flange 32 of the sleeve 29 via a member 33. The spring 34 applies a comparatively low rotational resistance to the clutch plate 31.

Figure 4:
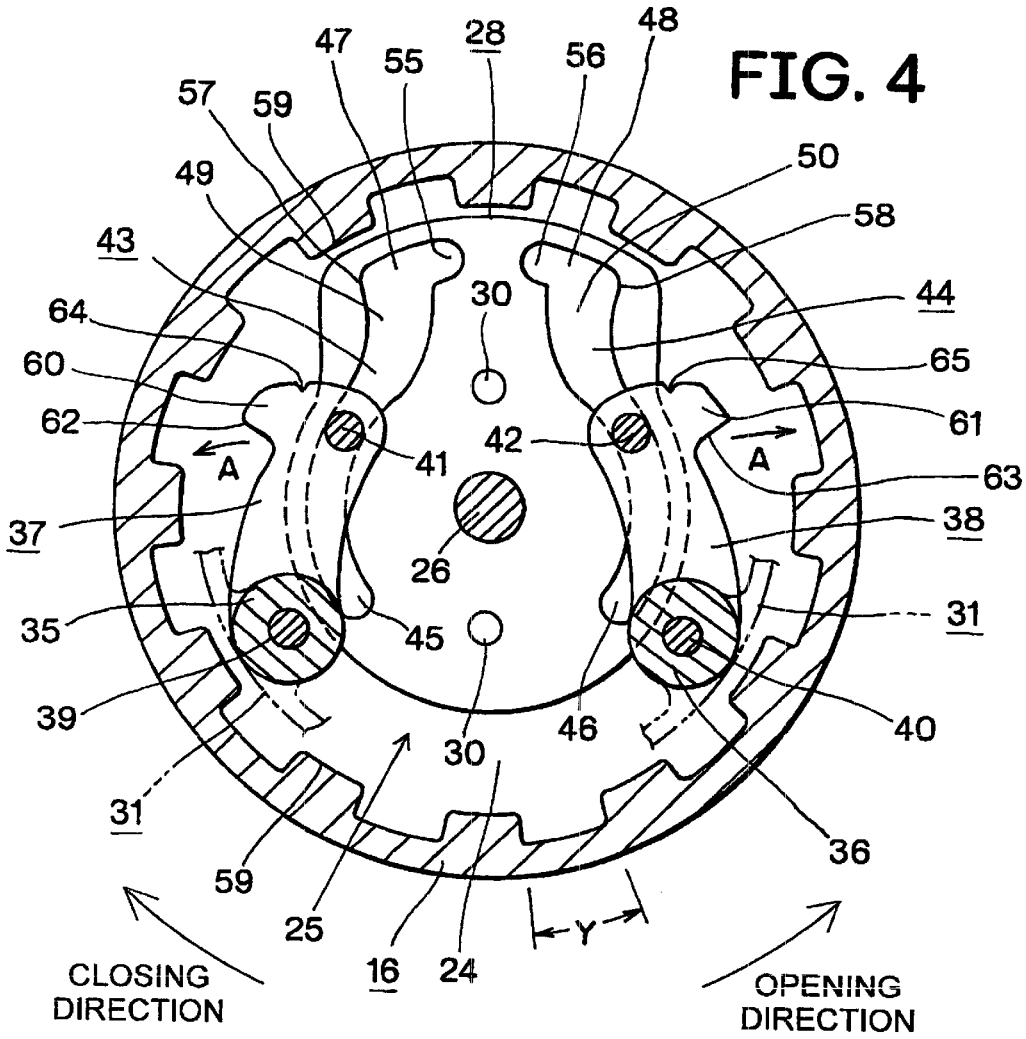
FIG. 4 is a longitudinal sectional front view showing an uncoupled state of a clutch mechanism of the sliding device.
Figure 6:
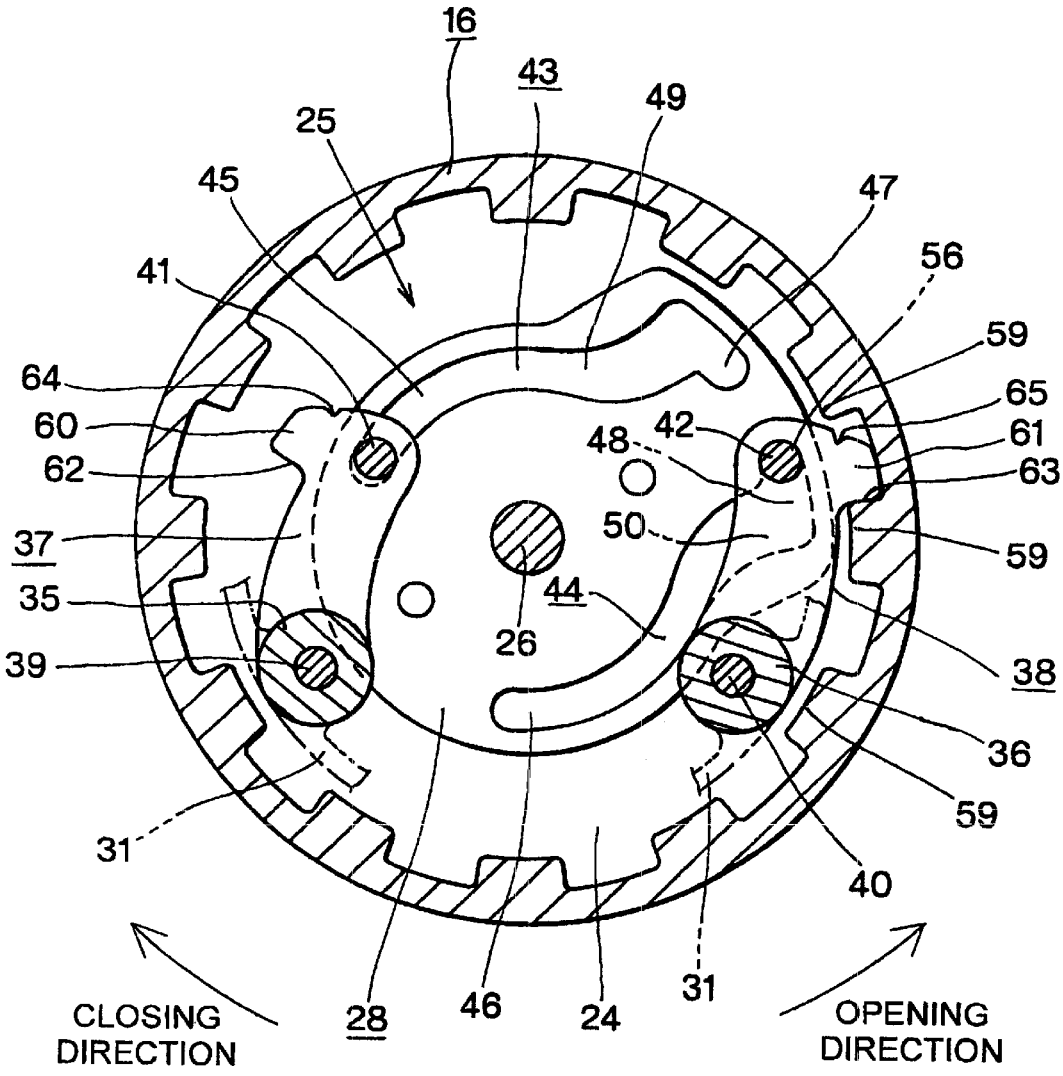
FIG. 6 is a longitudinal sectional front view showing a first coupled state of the clutch mechanism.
Figure 7:
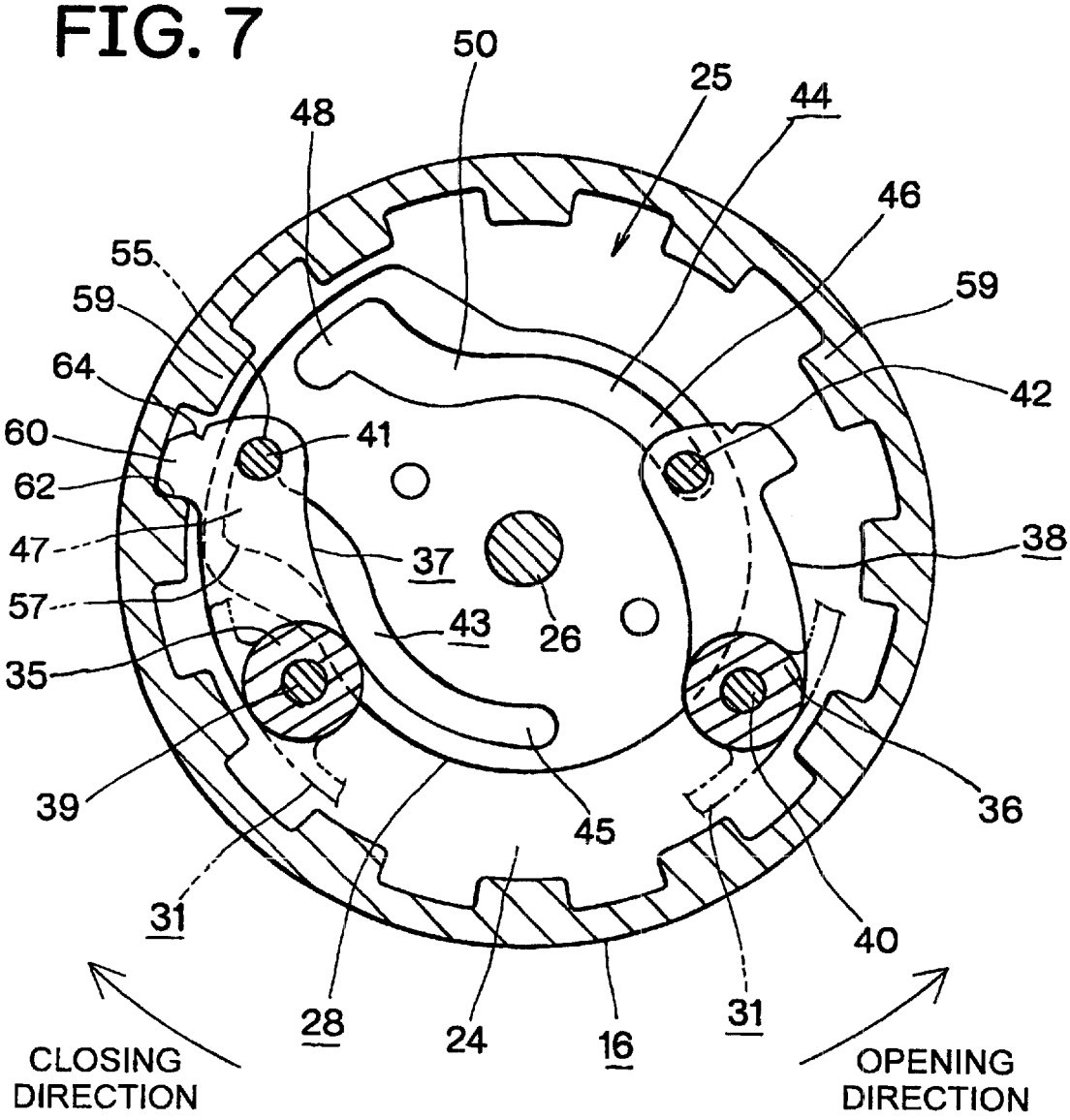
FIG. 7 is a longitudinal sectional front view showing a second coupled state of the clutch mechanism.

The clutch plate 31 has, on outer edge portions thereof, boss portions 35, 36 shown by the cross section in FIGS. 4, 6 and 7 to which clutch arms 37, 38 are rotatably attached by arm shafts 39, 40, respectively. The clutch arms 37, 38 respectively have, on the tip side thereof, slide pins 41, 42 which are slidably engaged with guide slots 43, 44 formed in the motor plate 28, respectively.

Figure 5:
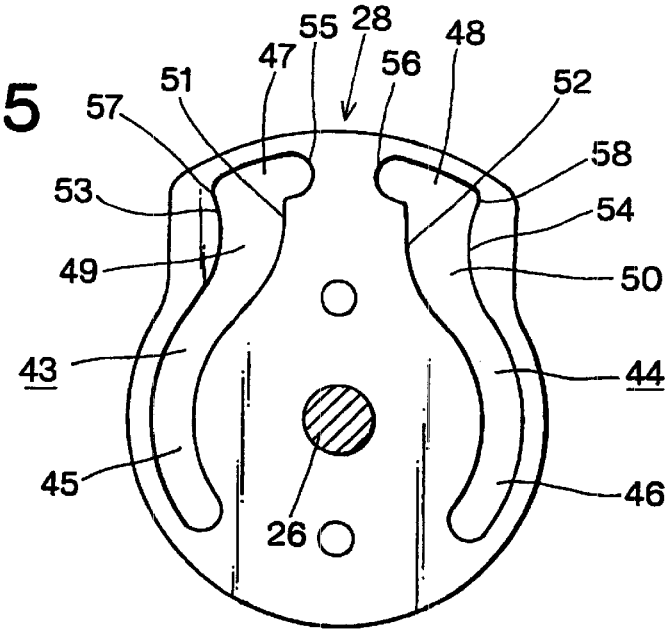
FIG. 5 is a front view of a motor plate of the clutch mechanism.

The guide slots 43, 44 are bilaterally symmetrical as best shown in FIG. 5. The guide slots 43, 44 respectively comprise circular arc inner slots 45, 46 around the drum shaft 26, circular arc outer slots 47, 48 around the drum shaft 26, and communication slots 49, 50 connecting the inner slots 45, 46 and the outer slots 47, 48. Each of the gaps between inside walls 51, 52 and outside walls 53, 54 of the communication slots 49, 50 is expanded as it is apart from the drum shaft 26. Semicircular engaging portions 55, 56 are respectively formed at one sides of both outer slots 47, 48. The other sides of the outer slots 47, 48 are respectively formed into contact faces 57, 58 which are flush with the outside walls 53, 54 with no difference in level.

On the inner surface of the wire drum 16, plural projections 59 projecting toward the drum shaft 26 are formed at constant gaps Y. At the tips of the clutch arms 37, 38, clutch pawls 60, 61 projecting in the direction apart from the drum shaft 26 are respectively formed. One sides of the clutch pawls 60, 61 are respectively formed into coupling faces 62, 63 roughly in parallel with the radial direction of the drum shaft 26. On the other sides of the clutch pawls 60, 61, brake dents 64, 65 are respectively formed.

When rotating the motor plate 28 by the motive power of the motor 14, one of the slide pins 41, 42, to be described later in detail, is relatively moved toward the corresponding one of the outer slots 47, 48 to rotate the corresponding one of the clutch arms 37, 38 in the direction of the arrow A, and the corresponding clutch arm enters the gap Y to be engaged with the projection 59 of the wire drum 16. At this moment, the other of the slide pins 41, 42 is merely moved in the corresponding one of the inner slots 45, 46, and accordingly, the other clutch arm is not engaged with the drum 16.

FIG. 13 is a block circuit diagram for performing a control operation in accordance with the present invention. The block circuit has a controller 66, an ammeter or a load detector 67 to measure the electric current flowing through the motor 14, a battery 68 on the vehicle body 13, an operation switch 69, a motor switch 70 and a stop switch 71.

The operation switch 69 has an open position for rotating the motor 14 in the opening direction, a close position for rotating the motor 14 in the closing direction and a neutral position. When the operation switch 69 is pushed, the controller 66 slides the sliding door 11 toward the closed position or the open position by the power of the motor 14.

The motor switch 70 is preferably arranged in the vicinity of a driver seat of the vehicle body 13, and the motor switch 70 has an open position for rotating the motor 14 in the opening direction, a close position for rotating the motor 14 in the closing direction and a neutral position. When the motor switch 70 is operated, the powered sliding device 10 is activated, and when the motor switch 70 is turned off, the powered sliding device 10 is stopped. Accordingly, it is possible to stop the sliding door 11 at a desired semi-open position between a full-closed position and a full-open position by the operation of the motor switch 70. This is convenient in the case that a driver does not wish to open the sliding door 11 widely due to strong wind and/or strong rain.

The stop switch 71 is used in the case of stopping the sliding door 11, which is slid under the control of the controller 66, at the semi-open position.

OPERATION

Uncoupled State of Clutch Mechanism 25

As shown in FIG. 4, when both slide pins 41, 42 of the clutch arms 37, 38 pivoted to the boss portions 35, 36 of the clutch plate 31 by arm shafts 39, 40 are engaged with the inner slots 45, 46 (of the motor plate 28) formed at a constant distance from the drum shaft 26, the clutch pawls 60, 61 of the clutch arms 37, 38 are both separated from the projections 59 of the wire drum 16 so as to be disengaged therewith. This state where both clutch pawls 60, 61 are disengaged from the projections 59 is the uncoupled state of the clutch mechanism 25, and in this state, the sliding door 11 can be moved by a manual power in the opening direction or in the closing direction, because the rotation of the wire drum 16 in any direction is not transmitted to the clutch pawls 60, 61 (motor plate 28 coupled with the motor 14).

Coupled State of Clutch Mechanism 25

In the uncoupled state, when rotating the motor 14 in the closing direction, the motor plate 28 is rotated in the closing direction in FIG. 4. At this time, since a rotational resistance is applied to the clutch plate 31 by the elasticity of the spring 34, the clutch plate 31 and the clutch arms 37, 38 attached to the plate 31 are not rotated around the drum shaft 26 at the beginning. Therefore, the slide pins 41, 42 of the clutch arms 37, 38 relatively move in the guide slots 43, 44 of the motor plate 28, and the slide pin 42 enters the communication slot 50 from the inner slot 46 of the guide slot 44, and the slide pin 42 is then guided by the inside wall 52 of the communication slot 50 to be gradually separated from the drum shaft 26, and thereby the clutch arm 38 is swung outward in the direction of the arrow A around the arm shaft 40. When the pin 42 reaches the outer slot 48 from the communication slot 50, the clutch pawl 61 of the clutch arm 38 projects outward to the utmost to enter the gap Y between projections 59 and 59, and the slide pin 42 is then engaged with the engaging portion 56 of the outer slot 48. During that moment, the other slide pin 41 merely moves in the inner slot 45 around the drum shaft 26, and accordingly, the other clutch arm 37 does not swing in the direction of the arrow A.

When the motor plate 28 is continuously rotated in the closing direction by the motive power of the motor 14 after the slide pin 42 has been engaged with the engaging portion 56 of the outer slot 48, the engaging portion 56 pushes the slide pin 42 to rotate the clutch arm 38 and the clutch plate 31 around the drum shaft 26 in the closing direction, and then, as shown in FIG. 6, the coupling face 63 of the clutch pawl 61 is engaged with the projection 59 of the wire drum 16 so as to rotate the drum 16 in the closing direction. This state where the coupling face 63 of the clutch pawl 61 is engaged with the projection 59 is the (first) coupled state of the clutch mechanism 25.

In FIG. 4, when rotating the motor plate 28 in the opening direction by the opening rotation of the motor 14, the other clutch arm 37 is swung in the direction of the arrow A, and then, as shown in FIG. 7, the coupling face 62 of the clutch pawl 60 is engaged with the projection 59 so as to rotate the wire drum 16 in the opening direction. This state where the coupling face 62 of the clutch pawl 60 is engaged with the projection 59 is the second coupled state of the clutch mechanism 25.

Brake State of Clutch Mechanism 25

When an external force in a direction of accelerating the door 11 is applied to the door 11 which is being slid by the motive power of the motor 14, the sliding door 11 is intended to slide at an over speed exceeding a predetermined speed set by the motor 14 and the reduction mechanism 15. Almost all of such the external door-accelerating force is the gravitational force which is applied to the door 11 due to the inclination of the vehicle body 13. This external accelerating force is always transmitted to the wire drum 16 via the wire cables 18 and 19.

Figure 8:
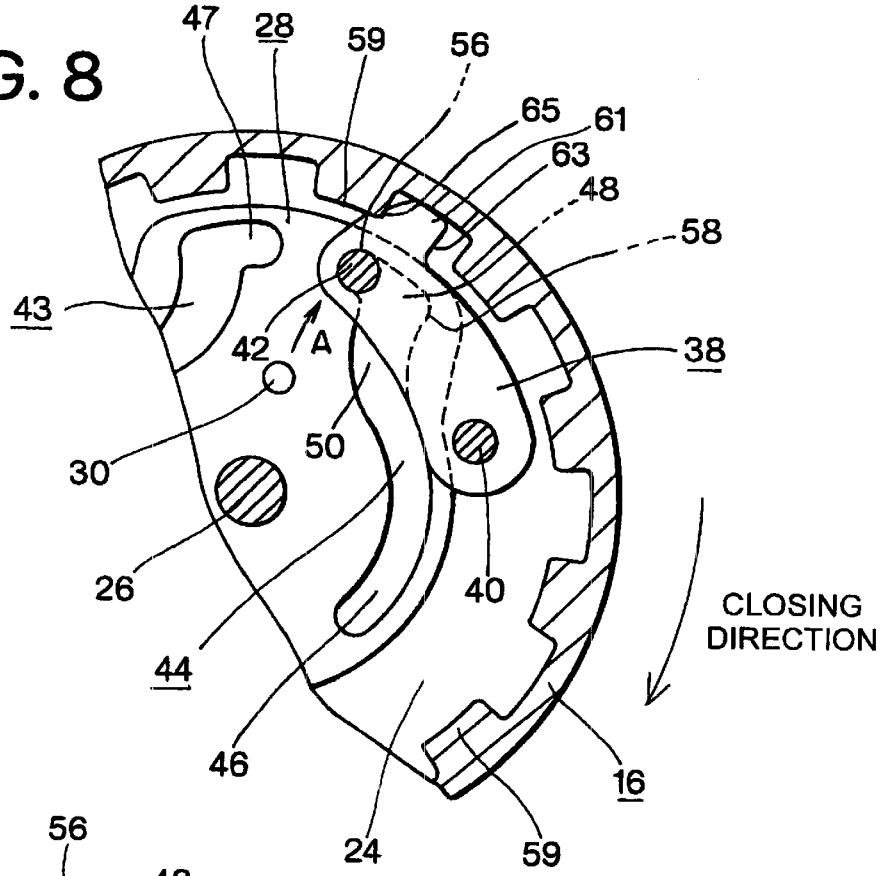
FIG. 8 is a partially cutaway sectional view showing a state where a wire drum of the sliding device is rotated in a door-closing direction from the first coupled state shown in FIG. 6.

For example, in the first coupled state (FIG. 6) for sliding the door 11 in the closing direction, when the external door-accelerating force is applied to the sliding door 11, the wire drum 16 is rotated in the closing direction at a speed faster than that of the motor plate 28 which is rotated in the closing direction at the predetermined speed by the motive power of the motor 14. Then, as shown in FIG. 8, another projection 59 catches up with and comes into contact with the brake dent 65 of the clutch pawl 61, and rotates the clutch arm 38 and clutch plate 31 in the closing direction around the drum shaft 26 at the over speed, thereby the slide pin 42 of the clutch arm 38 is pushed out of the engaging portion 56 and is moved in the outer slot 48 to come into contact with the contact face 58 of the outer slot 48 as shown in FIG. 9.

Figure 9:
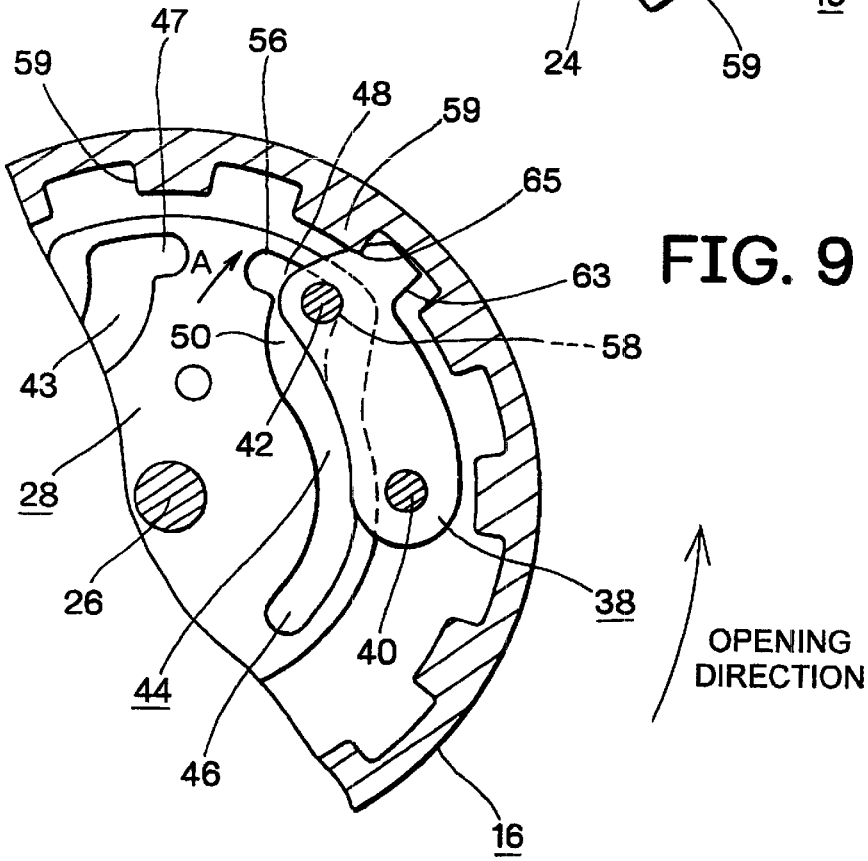
FIG. 9 is a partially cutaway sectional view showing a first brake state of the clutch mechanism.

When the slide pin 42 comes into contact with the contact face 58 of the outer slot 48 as shown in FIG. 9, the external door-accelerating force is transmitted from the wire drum 16 to the motor plate 28 through the slide pin 42. However, since the motor plate 28 is connected to the motor 14 through the reduction mechanism 15, the plate 28 cannot be rotated at a speed exceeding the predetermined speed set by the motor 14 and the reduction mechanism 15. Accordingly, a braking resistance by the motor plate 28 is applied to the sliding door 11 to decelerate the sliding door 11 down to the predetermined speed. The state where the projection 59 is engaged with the brake dent 65 to restrict the over speed of the sliding door 11 is the (first, brake state of the clutch mechanism 25.

Similarly, in the second coupled state (FIG. 7) for sliding the door 11 in the opening direction, when the external door-accelerating force is applied to the sliding door 11, the projection 59 is engaged with another brake dent 64 of the clutch arm 37 to keep the speed of the sliding door 11 at the predetermined speed. This state is the second brake state of the clutch mechanism 25.

Restoration of Clutch Mechanism 25 to Uncoupled State from Coupled State by Motor 14

The clutch mechanism 25 can be restored to the uncoupled state from the coupled state by rotating the motor 14 in the reverse direction for a predetermined time or by a predetermined amount.

When reversing the motor 14 so as to rotate the motor plate 28 in the opening direction while the clutch mechanism 25 is in the first coupled state shown in FIG. 6 by the closing rotation of the motor 14, the engaging portion 56 of the outer slot 48 is separated from the slide pin 42 of the clutch arm 38, and the contact face 58 on the opposite side comes into contact with the slide pin 42 (FIG. 11) to push the pin 42 in the reverse direction of the arrow A. When the motor plate 28 is stopped by the completion of the reverse rotation of the motor 14 in the predetermined amount, the slide pin 42 is restored to the inner slot 46 through the communication slot 50, thereby the clutch mechanism 25 is restored to the uncoupled state as shown in FIG. 4.

The restoration to the uncoupled state from the second coupled state of the clutch mechanism 25 is also performed on the basis of the same principle.

In principle, the controller 66 performs the restoring operation for reversing the motor 14 in the predetermined amount so as to restore the clutch mechanism 25 to the uncoupled state when the sliding movement of the sliding door 11 by the motor 14 is finished.

Restoration of Clutch Mechanism 25 to Uncoupled State from Brake State by Motor 14

The clutch mechanism 25 can be restored from the brake state to the uncoupled state through the coupled state by the motive power of the motor 14.

In the first coupled state (FIG. 6) of the clutch mechanism 25 for sliding the door 11 in the closing direction, when the external door-accelerating force is applied to the door 11, the clutch mechanism 25 is shifted to the first brake state as shown in FIG. 9 where the projection 59 is engaged with the brake dent 65. At this moment, it is unnecessary that the controller 66 judges whether the clutch mechanism 25 is in the first coupled state or in the first brake state. Because, the controller 66 performs the restoring operation of reversing the motor 14 in the predetermined amount in any state while monitoring the current value of the motor 14. If the clutch mechanism 25 is in the first coupled state, the clutch mechanism 25 is restored to the uncoupled state, as described above, by the completion of the reverse (opening) rotation of the motor 14 in the predetermined amount. During this time, the reverse rotation of the motor 14 does not rotate the wire drum 16 and no load of the motor 14 for rotating the drum 16 is detected by the ammeter 67. Accordingly, when the reverse rotation of the motor 14 is completed without the detection of the load of the motor 14, the controller 66 can finish the restoring operation.

However, when rotating the motor 14 in the reverse (opening) direction by the restoring operation while the clutch mechanism 25 is in the first brake state (FIG. 9), the reverse rotation of the motor plate 28 is immediately transmitted to the wire drum 16 through the contact between the brake dent 65 and the projection 59, and consequently, the load of the motor 14 is detected by the ammeter 67 before the reverse rotation in the predetermined amount of the motor 14 is completed.

When the substantial load of the motor 14 is detected during the reverse (opening) rotation of the motor 14, the controller 66 is capable of perceiving that the clutch mechanism 25 is in the first brake state, and the controller 66 immediately rotates the motor 14 in the closing direction to rotate the motor plate 28 in the closing direction alone in FIG. 9. Then, the engaging portion 56 of the outer slot 48 is engaged with the slide pin 42 as shown in FIG. 8, and the clutch arm 38 is rotated around the drum shaft 26 in the closing direction. After that, the coupling face 63 of the clutch pawl 61 is brought into contact with the projection 59, and the clutch mechanism 25 is shifted to the first coupled state shown in FIG. 6.

When the clutch mechanism 25 is displaced to the first coupled state, the closing rotation of the motor plate 28 is transmitted to the wire drum 16, thus the substantial load of the motor 14 is detected again. This second detection of the load enables the controller 66 to confirm the shift of the clutch mechanism 25 to the first coupled state from the first brake state, and therefore the controller 66 rotates the motor 14 in the opening direction in the predetermined amount to restore the clutch mechanism 25 from the first coupled state to the uncoupled state, as described above.

The restoration to the uncoupled state from the second brake state (FIG. 10) of the clutch mechanism 25 is also performed on the basis of the same principle.

Restoration of Clutch Mechanism 25 to Uncoupled State from Brake State by Manual Power The clutch mechanism 25 can be restored from the brake state to the uncoupled state by the manual power even when the motor 14 is in trouble.

Figure 11:
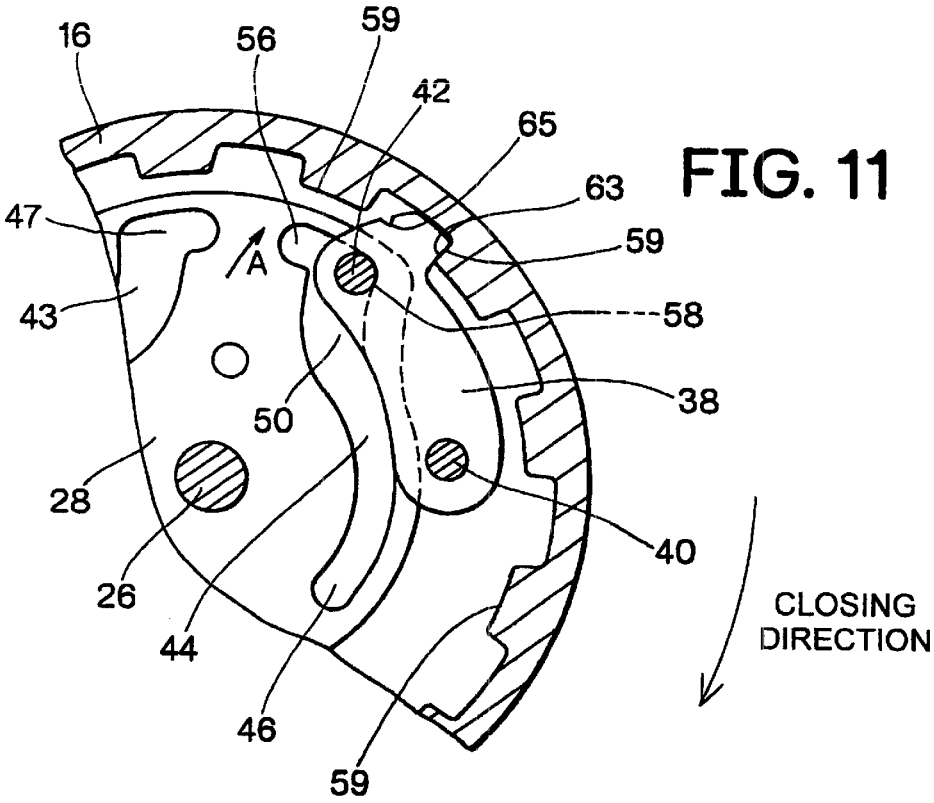
FIG. 11 is a partially cutaway sectional view showing a state where the wire drum is rotated in a door-opening direction from the first brake state shown in FIG. 9.

In the first brake state shown in FIG. 9, when the motor 14 breaks down, the wire drum 16 cannot be rotated in the closing direction by the contact between the slide pin 42 of the clutch arm 38 and the contact face 58 of the motor plate 28. However, the drum 16 is capable of being rotated in the opening direction. Therefore, the sliding door 11 is caused to be slid in the opening direction by the manual power so as to rotate the wire drum 16 in the opening direction through the wire cables 18 and 19. Then, the projection 59 of the drum 16 is separated from the brake dent 65, and another projection 59 is brought into contact with the coupling face 63 of the clutch pawl 61, as shown in FIG. 11, to swing the clutch arm 38 around the arm shaft 40 in the opposite direction of the arrow A, thereby, as shown in FIG. 12, the clutch pawl 61 is disengaged from the projection 59. The slide pin 42 shown in FIG. 12 is positioned in the communication slot 50, and is not restored to the inner slot 46, but this state is also included in the uncoupled state of the clutch mechanism 25.

The restoration to the uncoupled state from the second brake state (FIG. 10) of the clutch mechanism 25 is also performed on the basis of the same principle.

Restoration of Clutch Mechanism 25 to Uncoupled State from Coupled State by Manual Power The clutch mechanism 25 can be restored from the coupled state to the uncoupled state by the manual power even when the motor 14 is in trouble.

In the first coupled state shown in FIG. 6, when the motor 14 breaks down, the wire drum 16 cannot be rotated in the opening direction by the contact between the slide pin 42 of the clutch arm 38 and the engaging portion 56 of the motor plate 28. However, the drum 16 is capable of being rotated in the closing direction. Therefore, the sliding door 11 is caused to be slid in the closing direction by the manual power so as to rotate the wire drum 16 in the closing direction through the wire cables 18 and 19. Then, the projection 59 is separated from the coupling face 63 of the clutch pawl 61, and as shown in FIG. 8, another projection 59 is brought into contact with the brake dent 65 of the clutch pawl 61 to rotate the clutch arm 38 in the closing direction around the drum shaft 26, and consequently, the clutch mechanism 25 is shifted to the first brake state shown in FIG. 9, and further sliding movement in the closing direction of the sliding door 11 is substantially impossible because of the contact between the slide pin 42 and the contact face 58. After the shift to the first brake state, the clutch mechanism 25 is restored to the uncoupled state by sliding the door 11 in the opening direction by the manual power, as described above.

The restoration to the uncoupled state from the second coupled state of the clutch mechanism 25 is also performed on the basis of the same principle.

Door-Opening Cancellation Operation

The stop switch 71 is used in the case of stopping, at a desired semi-open position, the sliding door 11 which is being slid in the opening direction under the door-opening operation of the controller 66.

Figure 10:
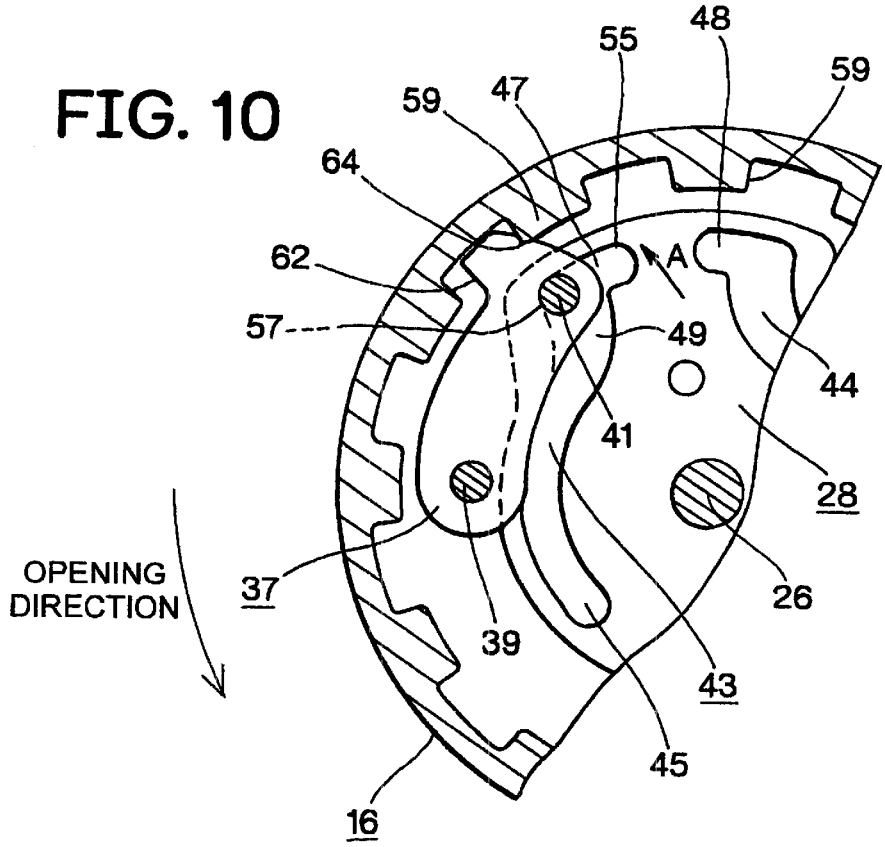
FIG. 10 is a partially cutaway sectional view showing a second brake state of the clutch mechanism.

During the slide movement of the door 11 in the opening direction, the clutch mechanism 25 is held in the second coupled state shown in FIG. 7 when the vehicle body 13 is in a horizontal state, a nose-down inclined state or a gentle nose-up inclined state where no strong door-accelerating force is applied to the door 11, and the clutch mechanism 25 is held in the second brake state shown in FIG. 10 when the vehicle body 13 is in a steep nose-up state where the strong door-accelerating force is applied to the door 11.

Figure 14:
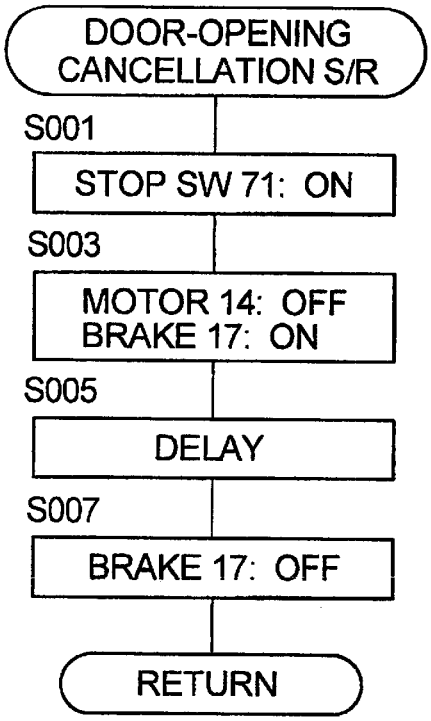
FIG. 14 is a flow chart showing a door-opening cancellation subroutine.

When the sliding door 11 reaches to the desired semi-open position to operate the stop switch 71, as shown in FIG. 14, the controller 66 performs the door-opening cancellation operation, and it stops the motor 14 as well as actuates the auxiliary brake 17 (S003). At a point of time when the motor 14 stops, the inertia force remains in the sliding door 11 in spite of the inclined state of the vehicle body 13. However, since the auxiliary brake 17 restrains the rotation of the wire drum 16, the wire drum 16 is not rotated excessively by the inertia force of the sliding door 11. When the inertia force of the sliding door 11 evanishes due to the elapse of a predetermined time (S005), the controller 66 stops the actuation of the auxiliary brake 17 (S007) without returning the clutch mechanism 25 to the uncoupled state, and terminates the cancellation operation.

Directly after the termination of the cancellation operation, the clutch mechanism 25 is in the same state before the cancellation operation is performed. Thus, if the vehicle body 13 is in the steep nose-up state, the clutch mechanism 25 is held in the second brake state (FIG. 10). In this state, although the strong external force in the opening direction is applied to the sliding door 11 due to the inclination of the vehicle body 13, the sliding door 11 is held at the semi-open position, because the second brake state of the clutch mechanism 25 can immediately transmit the opening rotation of the wire drum 16 to the motor plate 28.

On the contrary, when the cancellation operation is terminated as the clutch mechanism 25 is in the second coupled state (FIG. 7), the vehicle body 13 is in any state of the horizontal state, the nose-down state or the gentle nose-up state. If the vehicle body 13 is in the horizontal state, no external force is applied to the sliding door 11, so that the door 11 is held at the semi-open position. If the vehicle body 13 is in the nose-down state, the external force in the closing direction is applied to the door 11. However, since the second coupled state can immediately transmit the closing rotation of the wire drum 16 to the motor 14, the sliding door 11 is held at the semi-open position.

Alternatively, if the vehicle body 13 is in the gentle nose-up state, a weak external force in the opening direction is applied to the sliding door 11. Therefore, when the wire drum 16 is released from restriction of the auxiliary brake 17 after the termination of the cancellation operation, the door 11 is gradually slid in the opening direction, rotating the wire drum 16 in the opening direction in FIG. 7. However, since the clutch mechanism 25 can be immediately switched to the second brake state (FIG. 10) by the opening rotation of the wire drum 16, the sliding door 11 is substantially held at the semi-open position by the function of the clutch mechanism 25 after the sliding door 11 merely moves in the opening direction very slightly.

As described above, the sliding door 11 can be held at the semi-open position by the semi-open holding function of the clutch mechanism 25. Further, the auxiliary brake 17 is not actuated while the door 11 is held at the semi-open position, so that it is possible to move the door 11 by the manual operation by restoring the clutch mechanism 25 to the uncoupled state.

In the present invention, as described above, the rotation of the wire drum 16 is restricted by the auxiliary brake 17 when stopping the sliding door 11 at the semi-open position by the stop switch 71. Since this is a feature of the present invention, this cause will be explained below.

At a point of time when the opening rotation of the motor 14 is stopped by the stop switch 71, the inertia force in the opening direction remains in the sliding door 11 in spite of the inclined state of the vehicle body 13. Therefore, if the wire drum 16 is not restricted by the auxiliary brake 17, the wire drum 16 may be moved in the opening direction due to the inertia. If such a movement occurs in the second coupled state shown in FIG. 7, the projection 59 of the wire drum 16 abuts against the brake dent 64 of the clutch pawl 60 to move the clutch arm 37 in the opening direction around the drum shaft 26, and thereby the clutch mechanism 25 is displaced into the second brake state shown in FIG. 10. Even if the clutch mechanism 25 is switched to the second brake state in this way, normally, this does not involve a problem. However, if the vehicle body 13 is in the nose-down inclined state, the door 11 is slid in the closing direction after the inertia in the opening direction evanishes. Then, the wire drum 16 is rotated in the closing direction in the second brake state shown in FIG. 10, so that the clutch mechanism 25 is returned to the uncoupled state and the clutch mechanism 25 loses the semi-open holding function. Therefore, according to the present invention, an influence of the inertia on the sliding door 11 by the auxiliary brake 17 is excluded.

If the activation and the stop of the motor 14 are controlled by the operation of the motor switch 70 in place of the stop switch 71, the present invention provides the same effect.

Door-Closing Cancellation Operation

In the case of stopping, at a desired semi-open position, the sliding door 11 being slid in the closing direction under the door-closing operation of the controller 66, as same as the "Door-Opening Cancellation Operation", the stop switch 71 is also used. However, the control operation of the controller 66 is slightly different from the above cancellation operation. That is, the door-closing cancellation operation is terminated after the controller 66 switches the clutch mechanism 25 into the second coupled state (FIG. 7) for opening the door 11 from the first coupled state (FIG. 6) and the first brake state (FIG. 9) for closing the door 11.

The door-closing cancellation operation will be described below. During the slide movement of the door 11 in the closing direction, the clutch mechanism 25 is held in the first coupled state shown in FIG. 6 when the vehicle body 13 is in the horizontal state, the nose-up inclined state or the gentle nose-down inclined state where no strong door-accelerating force is applied to the door 11, and the clutch mechanism 25 is held in the first brake state shown in FIG. 9 when the vehicle body 13 is in the steep nose-down state where the strong door-accelerating force is applied to the door 11.

Figure 15:
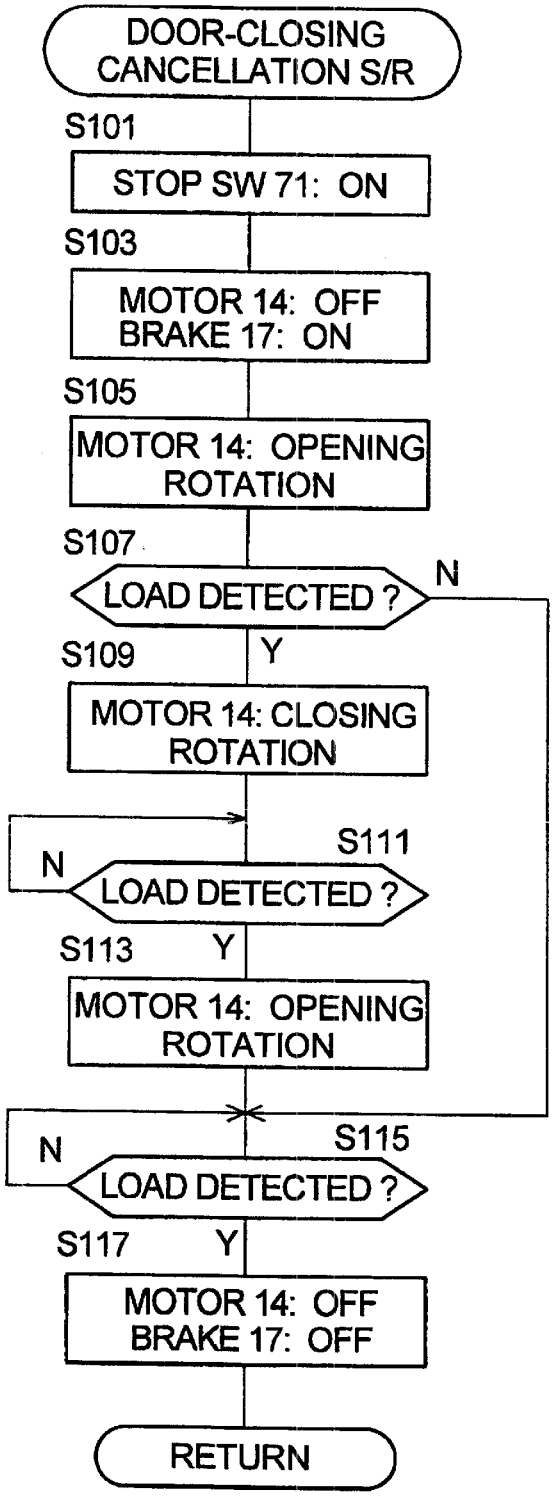
FIG. 15 is a flow chart showing a door-closing cancellation subroutine.

When the sliding door 11 reaches to the desired semi-open position to operate the stop switch 71, as shown in FIG. 15, the controller 66 performs the door-closing cancellation operation, and it stops the motor 14 as well as actuates the auxiliary brake 17 (S103). At a point of time when the motor 14 stops, the inertia force remains in the sliding door 11 in spite of the inclined state of the vehicle body 13. However, since the auxiliary brake 17 restrains the rotation of the wire drum 16, the wire drum 16 is not rotated excessively by the inertia force of the sliding door 11. Accordingly, in this time, the clutch mechanism 25 is held in the first coupled state or the first brake state.

Consequently, the controller 66 reversely rotates the motor 14 in the opening direction as it continues to restrict the rotation of the wire drum 16 by the auxiliary brake 17 (S105). In the case that the clutch mechanism 25 is in the first brake state (FIG. 9), when the motor 14 (plate 28) is rotated in the opening direction, the opening rotation of the motor plate 28 is immediately transmitted to the wire drum 16, so that the ammeter 67 detects the load of the motor 14 in the predetermined time (S107). Thereby, the controller 66 rotates the motor 14 in the closing direction (S109) to switch the clutch mechanism 25 into the first coupled state shown in FIG. 6. Then, the closing rotation of the motor plate 28 is transmitted to the wire drum 16, and the ammeter 67 detects the load of the motor 14 again (S111), and the controller 66 rotates the motor 14 in the opening direction (S113) until the ammeter 67 further detects the load of the motor 14 (S115). After that, the clutch mechanism 25 is displaced into the second coupled state shown in FIG. 7, and the controller 66 stops the motor 14 as well as stops the actuation of the auxiliary brake 17 (S117) and terminates the cancellation operation.

Alternatively, when in the step 105 the controller 66 rotates the motor 14 in the opening direction while the clutch mechanism 25 is in the first coupled state (FIG. 6), no load of the motor 14 is detected within the predetermined time in step 107, and the clutch mechanism 25 is then displaced into the second coupled state shown in FIG. 7. By displacement into the second coupled state, the load of the motor 14 is detected (S115). Then, stopping the motor as well as stopping the actuation of the auxiliary brake 17 (S117), the controller 66 terminates the cancellation operation.

Thus, according to the "Door-Closing Cancellation Operation" of the present invention, the controller 66 stops the actuation of the auxiliary brake 17 after switching the clutch mechanism 25 into the second coupled state shown in FIG. 7.

In this second coupled state, although the external force in the closing direction is applied to the sliding door 11 due to the nose-down state of the vehicle body 13, the sliding door 11 is held at the semi-open position, because the second coupled state of the clutch mechanism 25 can immediately transmit the closing rotation of the wire drum 16 to the motor plate 28.

Alternatively, in the above second coupled state, if the external force in the opening direction is applied to the sliding door 11 due to the nose-up state of the vehicle body 13, the door 11 is gradually slid in the opening direction, rotating the wire drum 16 in the opening direction in FIG. 7. However, since the clutch mechanism 25 can be switched to the second brake state (FIG. 10) by the opening rotation of the wire drum 16, the sliding door 11 is substantially held at the semi-open position by the function of the clutch mechanism 25 after the sliding door 11 merely moves in the opening direction very slightly.

As described above, the sliding door 11 can be held at the semi-open position by the semi-open holding function of the clutch mechanism 25. Further, the auxiliary brake 17 is not actuated while the door 11 is held at the semi-open position, so that it is possible to move the door 11 by the manual operation by restoring the clutch mechanism 25 to the uncoupled state.

Additionally, it will be noted that the restriction of the auxiliary brake 17 allows the clutch mechanism 25 to be displaced into the second coupled state shown in FIG. 7 in spite of any inclined state of the vehicle body 13, without moving the door 11.

Prevention of Unintentional Door Movement from Semi-Open Position

As described above, after stopping the sliding door 11 at the semi-open position by the operation of the stop switch 11 or the motor switch 70, the clutch mechanism 25 is displaced into the second coupled state (FIG. 7) or the second brake state (FIG. 10) despite of the sliding direction of the sliding door 11. The second coupled state of the clutch mechanism 25 can decrease a possibility that the semi-open holding function of the clutch mechanism 25 is released unintentionally when the vehicle body 13 is in the nose-down state. Such an unintentional release of the semi-open holding function allows the closing movement of the sliding door 11 which may cause an accident.

That is, both of the first brake state (FIG. 9) and the second coupled state (FIG. 7) of the clutch mechanism 25 can hold the door 11 at the semi-open position in the nose-down state. However, the holding function of the first brake state can be released by the slight movement of the sliding door 11 in the opening direction. On the contrary, the second coupled state of the clutch mechanism 25 requires the relative large movement of the sliding door 11 in the opening direction to return to the uncoupled state.

Door-Closing from Semi-Open Position by Motor 14

Figure 16:
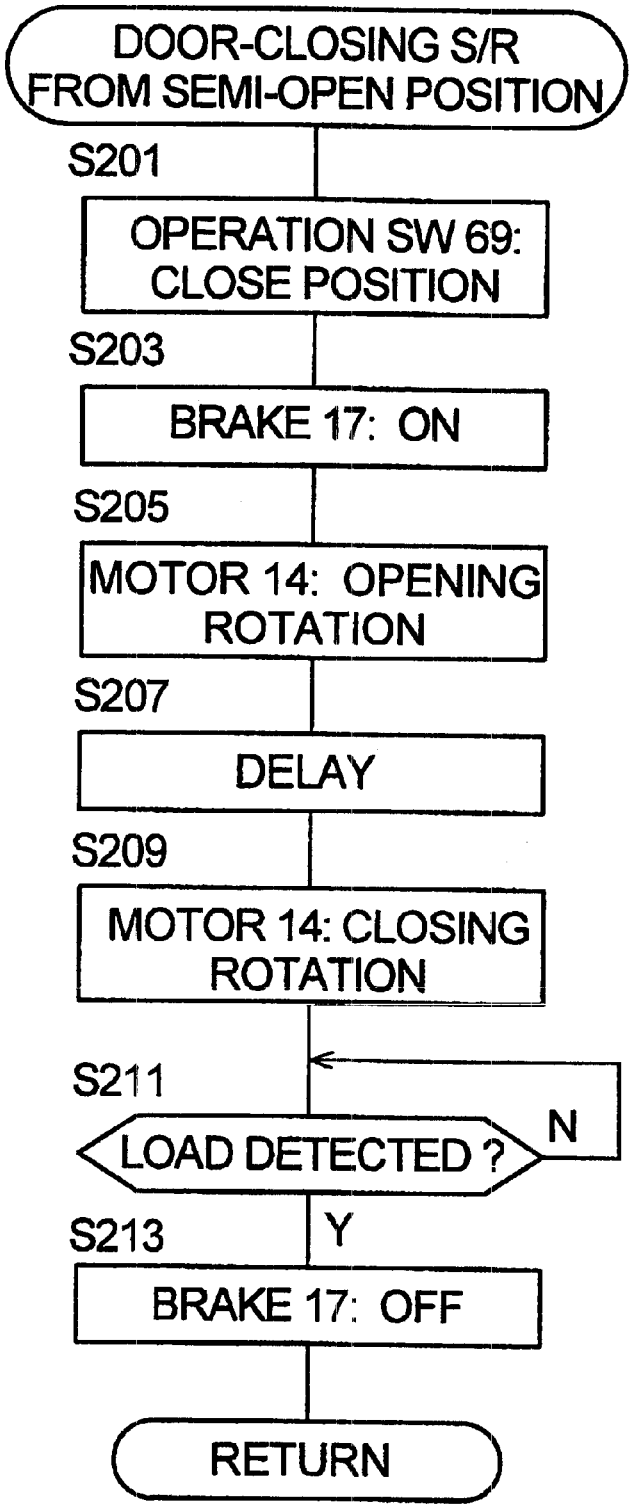
FIG. 16 is a flow chart showing a door-closing subroutine under a semi-open state.

When the operation switch 69 is operated in the closing direction in the state that the sliding door 11 is held at the semi-open position by the second coupled state (FIG. 7) or the second brake state (FIG. 10) of the clutch mechanism 25, the controller 66 operates the auxiliary brake 17 to restrict the rotation of the wire drum 16 (S203) as shown in FIG. 16, and rotates the motor 14 in the opening direction during a predetermined time (S205 and S207) so as to surely displace the clutch mechanism 25 into the second coupled state in spite of the inclined state of the vehicle body 13, without rotating the wire drum 16. After restoration of the clutch mechanism 25 to the second coupled state, the motor 14 is rotated in the closing direction (S209), continuously actuating the auxiliary brake 17, and then the clutch mechanism 25 is switched to the first coupled state (FIG. 6) through the uncoupled state of FIG. 4. Thus, the ammeter 67 detects the load of the motor 14 (S211), and the controller 66 releases the restriction of the wire drum 16 by the auxiliary brake 17 (S213) so as to slide the door 11 by the force of the motor 14 in the closing direction.

The slide door 11 is slid in the closing direction from the semi-open position after returning the clutch mechanism 25 in the second coupled state or the second brake state into the first coupled state in order to simplify the control for returning the clutch mechanism 25 to the uncoupled state after the completion of the closing movement of the sliding door 11. For example, when rotating the motor 14 in the closing direction in the state where the clutch mechanism 25 is in the second coupled state due to the nose-down inclined state of the vehicle body 13, without displacing the clutch mechanism 25 into the first coupled state, the motor plate 28 is rotated in the closing direction in FIG. 7. However, by the nose-down inclination of the vehicle body 13, the external force in the closing direction is applied to the wire drum 16, so that the wire drum 16 may be rotated in the closing direction regardless of the closing rotation of the motor plate 28, and the second coupled state of the clutch mechanism 25 may not be released.

If the clutch mechanism 25 fails to be displaced into the first coupled state or in the first brake state by the closing rotation of the motor 14, the control operation of returning the clutch mechanism 25 into the uncoupled state at the end of the door-closing operation becomes complicated, and it takes a long time to return the clutch mechanism 25 to the uncoupled state since the controlling steps are increased. This problem has a great impact particularly in a constitution that the sliding door 11 is equipped with a powered closing device (not shown) which is capable of closing the door 11 from a half-latch position to a full-latch position.

What is claimed is:

1. A control method of sliding a vehicle door by a powered sliding device having a clutch mechanism, wherein said clutch mechanism is switched to a first coupled state for transmitting a door-closing rotation of a motor to a wire drum when the motor is rotated in a door-closing direction, and is switched to a second coupled state for transmitting a door-opening rotation of the motor to the wire drum when the motor is rotated in a door-opening direction, and is switched to a first brake state for transmitting a door-closing rotation of the wire drum to the motor when the wire drum is relatively rotated in a door-closing direction with respect to the motor in the first coupled state, and is switched to a second brake state for transmitting a door-opening rotation of the wire drum to the motor when the wire drum is relatively rotated in a door-opening direction with respect to the motor in the second coupled state, and is switched to an uncoupled state when the motor is rotated in the door-opening direction in the first coupled state or the motor is rotated in the door-closing direction in the second coupled state, and is returned to the uncoupled state when the wire drum is rotated in the door-opening direction in the first brake state or the wire drum is rotated in the door-closing direction in the second brake state; said method comprising:

stopping the motor in a state that the rotation of said wire drum is restricted by an auxiliary brake when said slide door reaches at a desired semi-open position between a door-open position and a door-closed position;

releasing restriction of said wire drum by said auxiliary brake when a predetermined time has elapsed.

2. The control method according to claim 1, wherein said clutch mechanism is displaced into the second coupled state by said motor while said auxiliary brake is actuated.

3. The control method according to claim 2, wherein when sliding said slide door being held at said semi-open position in the door-closing direction by said motor, said clutch mechanism is displaced into the first coupled state by said motor, restricting the rotation of the wire drum by the auxiliary brake, and after a completion of the displacement of the clutch mechanism into the first coupled state, said restriction by said auxiliary brake is released.

* * * * *